US010736418B2

(12) United States Patent
Culverson

(10) Patent No.: US 10,736,418 B2
(45) Date of Patent: Aug. 11, 2020

(54) KEG STORAGE ASSEMBLY WITH SECUREMENT HOOK

(71) Applicant: Harold Culverson, Oakhurst, CA (US)

(72) Inventor: Harold Culverson, Oakhurst, CA (US)

( * ) Notice: Subject to any disclaimer, the term of this patent is extended or adjusted under 35 U.S.C. 154(b) by 0 days.

(21) Appl. No.: 14/999,859

(22) Filed: Jul. 8, 2016

(65) Prior Publication Data

US 2019/0239642 A1 Aug. 8, 2019

(51) Int. Cl.
*A47B 81/00* (2006.01)
*A47B 96/14* (2006.01)

(52) U.S. Cl.
CPC ..... *A47B 81/007* (2013.01); *A47B 96/14* (2013.01)

(58) Field of Classification Search
CPC ..... A47B 81/007; A47B 96/14
USPC ..... 211/85.22
See application file for complete search history.

(56) References Cited

U.S. PATENT DOCUMENTS 1,615,919 A * 2/1927 Sheldon ..... B62B 1/264 280/47.27
1,975,651 A * 10/1934 Wolfe ..... A47B 81/007 211/85.21
2,385,514 A * 9/1945 Hawkins ..... B62B 3/104 280/10
2,406,183 A * 8/1946 Allen ..... B62B 1/12 280/13
2,511,623 A * 6/1950 Darcangelo ..... B62B 1/264 414/454
3,436,093 A * 4/1969 Ruffley, Jr. ..... B62B 1/264 280/47.27
3,815,767 A * 6/1974 Lund ..... B62B 1/264 280/47.18
5,123,666 A * 6/1992 Moore ..... B62B 1/14 280/47.18
5,362,078 A * 11/1994 Paton ..... B62B 1/12 280/35
5,406,996 A * 4/1995 Wagner ..... B66F 9/06 141/364
5,913,527 A * 6/1999 Hailston ..... B62B 1/14 280/47.24
6,247,710 B1 * 6/2001 Luberda ..... B62B 1/14 280/47.18
6,454,281 B1 * 9/2002 Pearson ..... B62B 1/125 280/47.26
6,659,476 B2 * 12/2003 Weida ..... B62B 1/26 211/85.11
6,851,563 B1 * 2/2005 Lipari ..... A47F 7/283 211/59.4
7,628,406 B1 * 12/2009 Thomas ..... B62B 1/14 280/47.18

(Continued)

FOREIGN PATENT DOCUMENTS

GB 621508 A * 4/1949 ..... A47B 1/007
GB 2420771 A * 6/2006 ..... B62B 1/264

*Primary Examiner* — Stanton L Krycinski

(57) ABSTRACT

A storage assembly for vertical storage of a plurality of beer kegs. The storage assembly includes a frame comprising two vertical members and a series of attached horizontal members to support vertically stored beer kegs. The storage assembly has an inferior shelf and a superior shelf. The superior horizontal frame member comprises a centrally attached hook having a part which is positioned through an aperture of the superior keg to provide secure positioning on the superior shelf.

1 Claim, 2 Drawing Sheets

(56) References Cited

U.S. PATENT DOCUMENTS

| | | | | |
|---|---|---|---|---|
| 7,905,502 | B2 * | 3/2011 | Oliver | B25H 3/00 280/35 |
| 7,914,016 | B2 * | 3/2011 | Guttormson | B62B 1/12 211/74 |
| 9,150,234 | B2 * | 10/2015 | Beaver | B62B 3/10 |
| 9,550,506 | B2 * | 1/2017 | Nikora | B62B 1/14 |
| 9,950,724 | B2 * | 4/2018 | Huisman | B62B 1/14 |
| 2009/0084739 | A1 * | 4/2009 | Shock | A47B 81/007 211/4 |
| 2011/0206487 | A1 * | 8/2011 | Morgan | B60B 29/00 414/427 |
| 2014/0001721 | A1 * | 1/2014 | Benko | B62B 5/025 280/47.28 |
| 2014/0271095 | A1 * | 9/2014 | Umans | B62B 1/12 414/800 |
| 2017/0232986 | A1 * | 8/2017 | Root, Jr. | B62B 1/264 280/47.24 |

* cited by examiner

KEG STORAGE ASSEMBLY WITH SECUREMENT HOOK

FIELD OF THE INVENTION

This invention relates generally to a storage assembly for securement of containers and particularly to vertical inline storage for beer kegs to minimize storage space.

BACKGROUND AND RELATED ART

Draft beer is sold by breweries and distributors in containers containing beer often referred to as kegs. These cylindrically shaped containers generally have two apertures at the superior end that allow for ease of dispensing.

Storage of beer kegs creates certain challenges because they are rather large, heavy and are not designed to be stackable. Establishments serving beer often do not have substantial storage space. As such, there is a need for a beer keg storage device that securely facilitates stacking of beer kegs to maximize available storage space.

One approach is illustrated in U.S. Pat. No. 4,354,599 issued to Brown et al. and consists of a keg saddle having a concave bottom surface for the storage of two beer kegs. This design was unsatisfactory because the beer dispensing mechanism was not readily accessible when beer kegs were stacked. Instability of the stackable beer keg using the keg saddle was also problematic when handling, transporting or storing beer kegs.

Another approach is disclosed in U.S. Pat. No. 4,600,033 issued to Baron wherein a guard for gas cylinder valves is shown and included a pair of flanges extending outwardly from the cylindrical portion of the guard. This design was not useful for stacking beer kegs for storage.

And still another approach is described in U.S. Pat. No. 5,224,678 issued to McClellan where a cylindrical resilient sleeve element designed with a pair of saddles is adapted to receive a horizontally oriented beer keg. The cylindrical resilient sleeve member also incorporates a pair of apertures that allow for dispensing beer. This design is not useful as the beer kegs today have been redesigned with apertures built into the beer keg itself making the design redundant and additionally, the horizontally placed beer keg creates an unstable situation where both kegs can be accidently and easily tipped over.

SUMMARY OF THE INVENTION

The present invention provides for a vertically oriented storage assembly that provides a stable platform and having a securement hook for the superiorly placed container to maintain proper orientation during storage and reduce the likelihood for the container to fall toward one side or the other that can result in an unstable situation.

BRIEF SUMMARY AND OBJECTS OF THE INVENTION

The present invention provides for a storage assembly for vertical storage of cylindrical beer kegs. Beer keg designs commonly have two opposing apertures on the superior rim of each keg that allow for ease of beer dispensing and handling. The storage assembly utilizes two shelf supports secured to a frame, side container supports and a superiorly positioned hook formed and positioned on a superior brace bar of the storage assembly for holding the superior beer keg securely in place by placing the hook through one of the keg apertures.

It is a primary objective to provide a stable storage assembly capable of storing beer kegs in a vertical position.

It is another primary objective to provide shelf supports for each stored beer keg.

It is also a primary objective to provide a securement hook designed to secure the superior keg to the storage assembly by positioning the securement hook through one of the beer keg apertures.

Another objective is to provide side supports to maintain the each vertically positioned beer keg in an upright positon

These and other objects and features of the present invention will be apparent from the detailed description taken with reference to accompanying drawings.

DETAILED DESCRIPTION OF THE ILLUSTRATED EMBODIMENTS

Reference is now made to the embodiments illustrated in FIG. 1-4.

Figure 1:
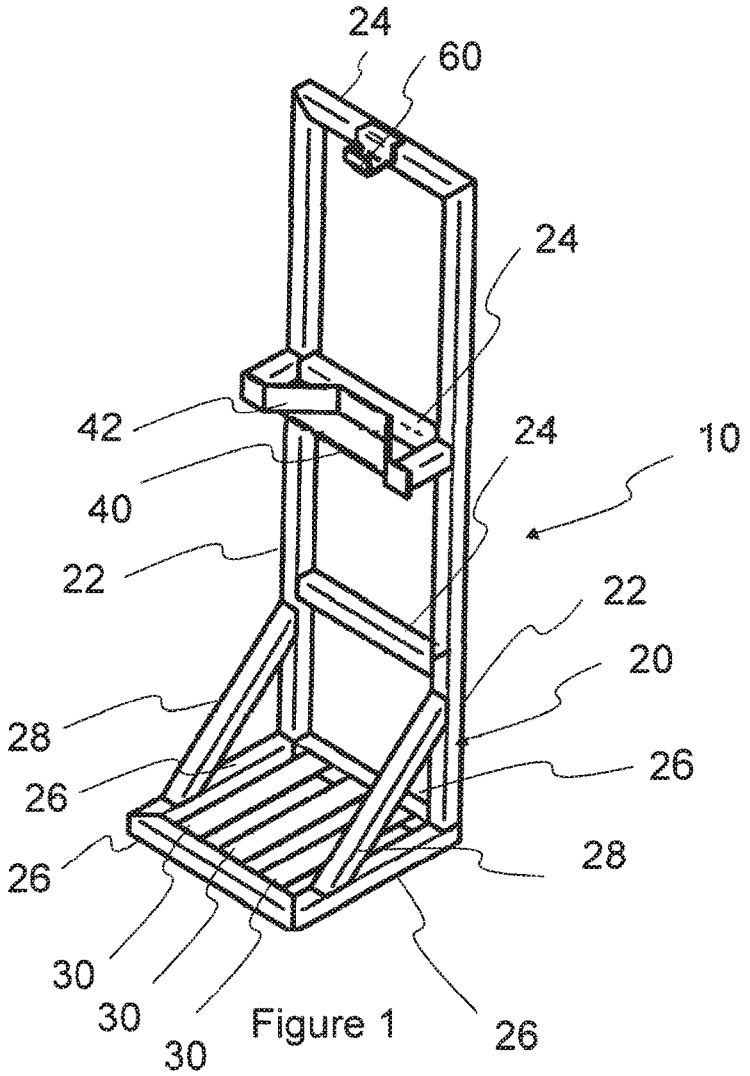
FIG. 1 is a perspective of the storage assembly with a frame, side supports, two shelves and a hook for securing the superior beer keg to the storage assembly.

Reference is now made to FIG. 1, wherein a storage assembly 10 made according to the instant invention is seen and is currently the preferred embodiment. The frame assembly is preferably made of metal although other materials such as graphite may be used when designed to support the weight of the containers and liquid contained within. The storage assembly 10 has a frame 20 comprising vertical frame members 22, horizontal support members 24, a base 26 and angled side supports 28 for stabilizing and creating a structurally sound frame 20. The storage assembly also includes an inferior horizontal shelf 30 and a superior horizontal shelf 40. Superior horizontal shelf 40 includes a centering support member 42. The most superior horizontal support member 24 has a securement hook 50 to securely affix kegs (see FIG. 3) to storage assembly 10 which is designed and formed to fit within the keg apertures.

Figure 2:
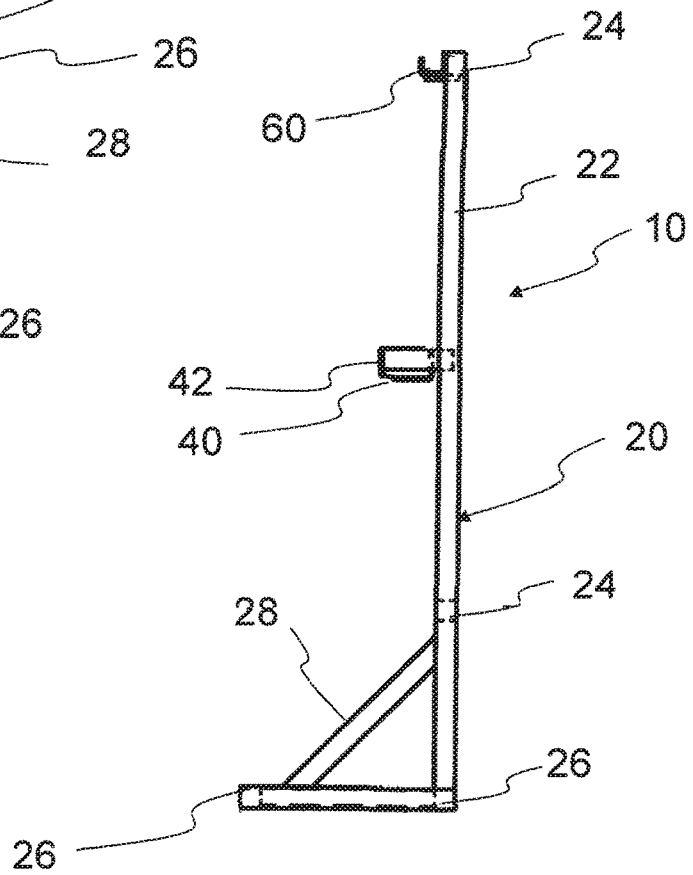
FIG. 2 is a side view of the storage assembly.

Reference is now made to FIG. 2 wherein the storage assembly 10 is shown in a side view. The preferred shape for securement hook 50 is noted.

Figure 3:
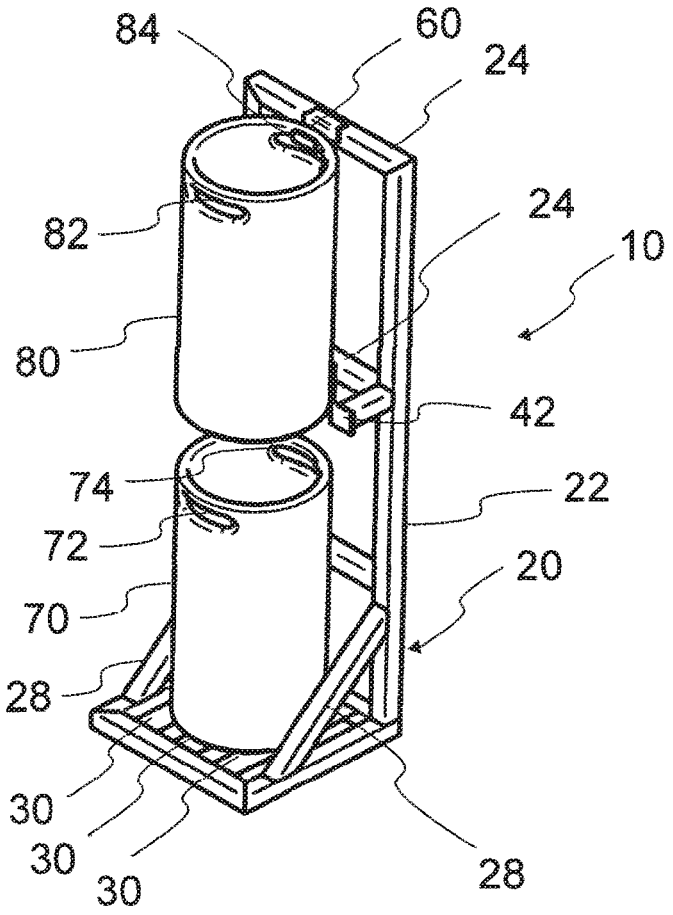
FIG. 3 is a forward perspective view of the storage assembly with two vertical beer kegs positioned for keg storage and/or dispensing.

Reference is now made to FIG. 3 wherein the storage assembly 10 is shown with an inferior beer keg 70 positioned on lower shelf 30 and having a first aperture 72 and a second aperture 74. Also shown is superior beer keg 80 positioned on superior shelf 40 and centered by centering member 42. Additionally, hook member 60 is secured through beer keg aperture 84 to maintain the beer keg securely on superior shelf 40. It should be noted that hook member 60 may be positioned through either beer keg aperture 82 or beer keg aperture 84.

Figure 4:
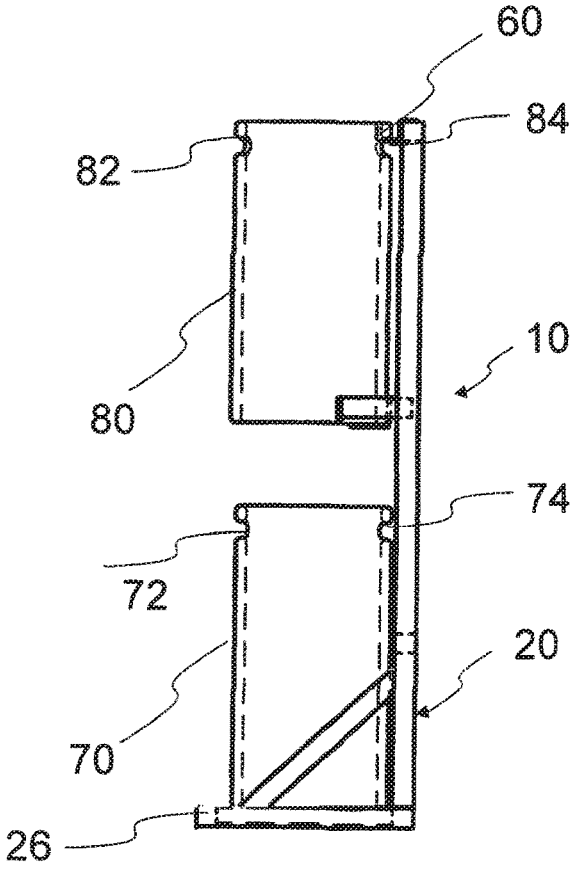
FIG. 4 is a side perspective view of the storage assembly with two kegs positioned during storage and/or dispensing.

Reference is now made to FIG. 4 wherein the storage assembly 10 is shown having inferior beer keg 70 and superior beer keg 80 vertically oriented to increase available space during storage and dispensing of beer.

The present embodiment should be considered in all respects as illustrative and not restrictive, the scope of the invention being indicated by the appended claims rather than by the forgoing description, and all changes which come within the meaning and range of equivalency of the claims are therefore intended to be embraced herein.

What is claimed and desired to be secured by Letters of Patents follows:

1. A keg storage system comprising:

a storage assembly (10);

the storage assembly (10) comprising a first vertical frame member (22), a second vertical frame member (22), an upper horizontal support member (24), an intermediate horizontal support member (24), a lower horizontal support member (24), a horizontal base (26), a first angled side support (28), a second angled side support (28), a lower horizontal shelf (30), an upper horizontal shelf (40) and a hook member (60);

the first vertical frame member (22) and the second vertical frame member (22) being offset from each other;

the upper horizontal support member (24) being connected in between the first vertical frame member (22) and the second vertical frame member (22);

the intermediate horizontal support member (24) being connected in between the first vertical frame member (22) and the second vertical frame member (22);

the lower horizontal support member (24) being connected in between the first vertical frame member (22) and the second vertical frame member (22);

the intermediate horizontal support member (24) being located in between the upper horizontal support member (24) and the lower horizontal support member (24);

the horizontal base (26) being connected in between the first vertical frame member (22) and the second vertical frame member (22);

the upper horizontal support member (24) and the horizontal base (26) being respectively located at two opposite ends of each of the first vertical frame member (22) and the second vertical frame member (22);

the lower horizontal support member (24) being located in between the intermediate horizontal support member (24) and the horizontal base (26);

the first angled side support (28) being connected in between the first vertical frame member (22) and the horizontal base (26);

the second angled side support (28) being connected in between the second vertical frame member (22) and the horizontal base (26);

the lower horizontal shelf (30) being connected with the horizontal base (26);

the lower horizontal shelf (30) being surrounded by the horizontal base (26);

the upper horizontal shelf (40) being connected with the first vertical frame member (22) and the second vertical frame member (22);

the upper horizontal shelf (40) being adjacently located to the intermediate horizontal support member (24);

the hook member (60) being connected with the upper horizontal support member (24);

the hook member (60) being located at a medial portion of the upper horizontal support member (24);

the horizontal base (26), the upper horizontal shelf (40) and the hook member (60) extending from each of the first vertical frame member (22) and the second vertical frame member (22) in the same direction;

the upper horizontal shelf (40) comprising a centering support member (42), a horizontal shelf body and a centering slot;

the centering support member (42) being connected in between the first vertical frame member (22) and the second vertical frame member (22);

the centering support member (42) and the horizontal shelf body being connected with each other;

the centering slot being delineated by the centering support member (42) and the horizontal shelf body;

an upper keg (80);

a lower keg (70);

the upper keg (80) comprising an upper keg body and an upper keg aperture (82, 84);

the upper keg aperture (82, 84) laterally traversing through the upper keg body;

the upper keg aperture (82, 84) being formed on an upper portion of the upper keg body;

the upper keg aperture (82, 84) being engaged with the hook member (60);

a lower portion of the upper keg body being positioned on the horizontal shelf body;

the lower portion of the upper keg body being inserted into the centering slot;

the lower keg (70) comprising a lower keg body;

a lower portion of the lower keg body being positioned on the lower horizontal shelf (30); and the lower horizontal shelf (30), the centering slot and the hook member (60) being vertically oriented to each other so as to render the upper keg (80) and the lower keg (70) vertically oriented to each other.

* * * * *